United States Patent [19]

Stoll

[11] Patent Number: 4,763,833

[45] Date of Patent: Aug. 16, 1988

[54] TOTE CARRIER WITH INTEGRALLY FORMED HANDLE STRAPS

[75] Inventor: Mark S. Stoll, Deephaven, Minn.

[73] Assignee: Liberty Diversified Industries, New Hope, Minn.

[21] Appl. No.: 37,246

[22] Filed: Apr. 10, 1987

[51] Int. Cl.[4] ..... B65D 5/46

[52] U.S. Cl. ..... 229/52 B; 217/125; 229/114; 229/914; 229/920; 229/DIG. 2

[58] Field of Search ..... 229/113, 114, 52 B, 229/52 AL, DIG. 2, DIG. 4, 190, 910, 914, 920; 217/122, 125

[56] References Cited

U.S. PATENT DOCUMENTS

| | | | |
|---|---|---|---|
| 279,756 | 6/1883 | Heston | 229/190 |
| 2,194,898 | 3/1940 | Hanford | 229/1.5 H |
| 3,032,230 | 5/1962 | Gerber | 217/125 |
| 3,182,881 | 5/1965 | Morphis | 229/3.1 |

FOREIGN PATENT DOCUMENTS

| | | | |
|---|---|---|---|
| 1095388 | 6/1955 | France | 229/52 B |
| 1309632 | 10/1962 | France | 229/DIG. 2 |
| 173324 | 12/1952 | German Democratic Rep. | 229/52 B |
| 356402 | 9/1961 | Switzerland | 229/52 B |
| 621983 | 3/1981 | Switzerland | 229/52 B |

*Primary Examiner*—Stephen Marcus
*Assistant Examiner*—Gary E. Elkins
*Attorney, Agent, or Firm*—Moore & Hansen

[57] ABSTRACT

A tote carrier formed from a generally planar blank of sheet material cut and scored to comprise a rectangular bottom panel, a pair of side wall panels and a pair of end wall panels hingedly connected to the bottom panel, and a pair of end foldover panels hingedly connected to the ends of each side wall panel. The side and end wall panels are folded upwardly to define an open top receptacle region. The end foldover panels are folded inwardly and may be attached either to the inner or outer surfaces of the end wall panels to secure the carrier in an upright position. Striplike portions along the top of each side wall panel, and an adjacent striplike portion of each end foldover panel, are separated from the corresponding side wall or end foldover panel by a cut line to define a pair of handle straps, while each end of the handle straps remain connected to the adjoining end foldover panels. The end portions of each strap handle are folded to orient a wide surface portion of the strap handle in the horizontal plane. Several like containers may be stacked in a vertical column for dispensing.

16 Claims, 1 Drawing Sheet

TOTE CARRIER WITH INTEGRALLY FORMED HANDLE STRAPS

BACKGROUND OF THE INVENTION

This invention relates generally to tote containers for transporting small articles, and particularly to an open top carrier which may be supported by integrally formed, straplike handles for carrying fruit, produce, and the like.

Existing tote carriers encompass a variety of familiar designs including baskets, buckets, pails, boxes, bags, trays, and chests. Many items are marketed for use as carrying totes without any designation or limitation as to the type or variety of articles with which they are suitable to use, or were particularly designed to contain, store, or carry.

Woven straw or wicker baskets, netted or crocheted bags, plastic or metal buckets and pails, and plastic or wire mesh shopping baskets are well known. Molded plastic, metal, or wooden trays, some having compartments for carrying such items as gardening implements, carpentry tools, or cleaning supplies, are also known. These baskets and trays generally have an integrally formed handle fixed in one position above the receptacle region, or one which is pivotably mounted to the sides of the basket or tray and may be pivoted between a raised position disposed over the top of the receptacle region and a lowered position below the side rim of the basket or tray.

Designs for other specialized tote carriers range from a simple rectangular sheet of fabric having wooden handles attached to each end for carrying fireplace logs, to more complicated structures having compartments, dividers, liners, lids, closures, handles, and the like.

Many designs for folded cardboard or fiberboard boxes, tote containers, and shipping packages are known. A recent example of such a tote design is shown in U.S. Pat. No. 4,600,142 which discloses a complex reverse elbow lock flap produce box. Another representative tote container, this type being particularly adapted for use by postal carriers, is shown in U.S. Pat. No. 3,982,690.

Tote carriers and baskets are often used by individuals while shopping in a store or marketplace. Such carriers are generally of a more durable construction, are intended for repeated use by several customers, and may often be too heavy or bulky to be easily carried by those who are older, injured, or have several other parcels to carry. In these situations, a lightweight, durable, reusable tote carrier which may be stored or displayed in a minimum of space and potentially purchased by the customer for an inexpensive price is preferable.

Some people have found that two-wheeled shopping carts of the type used to transport groceries or parcels from the store are helpful, but their use is limited to those surroundings having solid, flat surfaces on which to wheel the cart, and may often be a greater burden if it becomes necessary to carry the cart along with the parcels.

Another particular application where a lightweight, durable, reusable, and inexpensive tote carrier is desirable is in collecting fruits or produce at a "harvest-it-yourself" type farm or orchard. These facilities permit customers to enter the fields and select their own berries, produce, or other products. It is common for customers to carry several collapsible pint containers or plastic mesh fruit baskets into the fields. Once these containers are filled, however, they are difficult to carry and manage. Some customers have adopted carrying wooden or plastic tool and gardening trays which hold approximately eight standard pint containers, or will place their harvest into a shopping bag having handles and divide the load into smaller containers when they are preparing to depart.

The baskets, folded tote boxes or containers, trays, and other carriers described above each have one of several common deficiencies or drawbacks.

Many of the carriers are heavy in weight, and cannot be folded or broken down to a flat configuration for storage or shipping without damaging or destroying the container itself, or seriously impairing their structural integrity.

Several of the more durable basketlike totes are relatively expensive to manufacture. The less expensive cardboard or paperboard totes do not stand up well against the natural elements, or may be affected by moisture or destructive chemical substances found in their working environment.

Many of the larger tote containers have no handles or straps, and rely upon handgrips cut or formed into the side walls of the container. This can be inconvenient in situations where one hand is used to carry the tote, and can result in the tote tilting or spilling. Fixed handles generally obstruct the open top of the tote container's receptacle region, and pivotable handles present a weak link in the connection between the handle and the tote container which may not withstand the weight of a heavy load. The handles found on most baskets, buckets, and pails are narrow wires or bands.

Many of the baskets do not stack or nest well, encountering interference due to the shape of the receptacle region, the presence of a fixed handle disposed over the receptacle region or in an otherwise awkward position, or the placement of the handle mounting assemblies along the sides of the container thus preventing the totes from nesting completely. Many of those tote containers which may be nested are difficult to separate from one another, thus requiring that a person grip the top container and pry it from the lower containers, or in some way grip both the upper and lower containers to separate them.

BRIEF DESCRIPTION OF THE INVENTION

It is therefore one object of this invention to design a tote carrier which may be folded to an upright position from a substantially planar blank, and which defines an open top receptacle region and has integrally formed handles extending thereabove.

It further is a related object of this invention to design the above tote carrier such that the blank may be cut and scored from a unitary piece of sheet material.

It is yet another related object of this invention to design the above tote carrier such that a minimum quantity of the sheet material is consumed in forming the blank.

It is another object of this invention to design the above tote carrier such that several like carriers may be partially assembled to the upright position and nested in a vertical column without interference from the handles.

It is a related object of this invention to design the above tote carrier such that the handles have a straplike form and are disposed such that when several carriers are stacked in a column, a user may easily select the top carrier by folding the handles to a raised carrying position, and lifting the carrier by those handles.

It is still another object of this invention to design the above tote container such that the handles may be automatically pivoted to the raised carrying position by depressing control tabs connected to each end of the handle.

It is an additional object of this invention to design the above tote carrier such that the carrier may have two handles traversing the length of the carrier which can be gripped by a single hand of the user, with those handles being displaced a distance apart at the points where they are connected to the carrier to provide greater balance and stability when carrying a load which might be subject to shifting or spilling.

It is a further object of this invention to design the above tote carrier such that the handles present a handgrip region having a wide surface portion to distribute the weight of the articles contained within the receptacle region over a substantial area of the hand of the user, without requiring the addition or assembly of separate handgrip members.

It is a related object of this invention to design the above tote carrier such that the handles may be gripped in varying positions; i.e., abutting one another in an opened hand, overlapping, on edge, or with the handles being separated and held in opposing hands.

It is still another related object to design the above tote carrier such that the handles may be suspended or supported on a railing or other similar beamlike projection with the carrier maintaining its balance.

It is yet another object of this invention to design the above tote carrier to provide increased strength and durability, while retaining a degree of flexibility and resiliency, in both the walls defining the receptacle portion or the carrier and the handle straps.

It is an additional object of this invention to design the above tote carrier such that the receptacle region may be accessed through the open top without obstruction by the handle straps, yet the handles may be disposed above the top of the carrier for balanced carrying.

It is a related object of this invention to design the above tote carrier such that each end of the handles are located and positioned to prevent them from crushing the tops of fragile articles placed near the end walls of the receptacle region.

It is a distinct object of this invention to design a tote carrier which defines a receptacle region which may be accessed via either an open top portion, or an open or substantially open side wall portion, while retaining the benefits and advantages related to the straplike handle described above.

Described briefly, the tote carrier of this invention is formed from a generally planar blank of sheet material cut and scored to comprise a rectangular bottom panel, a pair of side wall panels and a pair of end wall panels hingedly connected to the bottom panel, and a pair of end foldover panels hingedly connected to the ends of each side wall panel. The side and end wall panels are folded upward to define a tapered, open-top receptacle region. The end foldover panels are folded inwardly to contact the surfaces of the end wall panels, and are attached thereto in order to secure the carrier in an upright position. In varying configurations, the end foldover panels may be attached to either the inner or outer surfaces of the end wall panels.

Striplike portions along the top of each side wall panel, and an adjacent striplike portion of each end foldover panel, are separated from the corresponding side wall or end foldover panel by a cut line to define a pair of handle straps, while each end of the handle straps remain connected to the adjoining end foldover panels. A portion of the end foldover panels adjacent to the ends of each handle strap are folded outwardly such that the handle straps pivot upwardly and fold across a fold line traversing the strap handle at a 45 degree angle, thus orienting a wide surface portion of each strap handle in the horizontal plane for carrying.

Several like tote carriers may be stacked or nested in a vertical column for dispensing, with the edges of the handle straps detached from the side wall or end foldover panels but not yet folded to the carrying position.

DESCRIPTION OF THE PREFERRED EMBODIMENTS

Figure 4A:
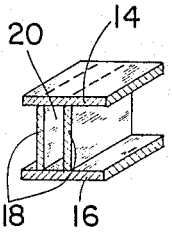
FIG. 4*a* is a cross-sectional view of the corrugated plastic sheet material used to construct the tote carrier of this invention taken through line 4—4 of FIG. 1 showing a multiplicity of beamlike interior plys.

The tote carrier of this invention is shown in FIGS. 1–4 and represented generally therein by reference numeral 10.

Figure 4B:
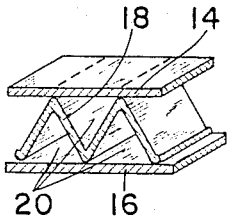
FIG. 4*b* is a cross-sectional view of the corrugated plastic sheet material used to construct the tote carrier of this invention taken through line 4—4 of FIG. 1 showing a convoluted interior ply.
Figure 1:
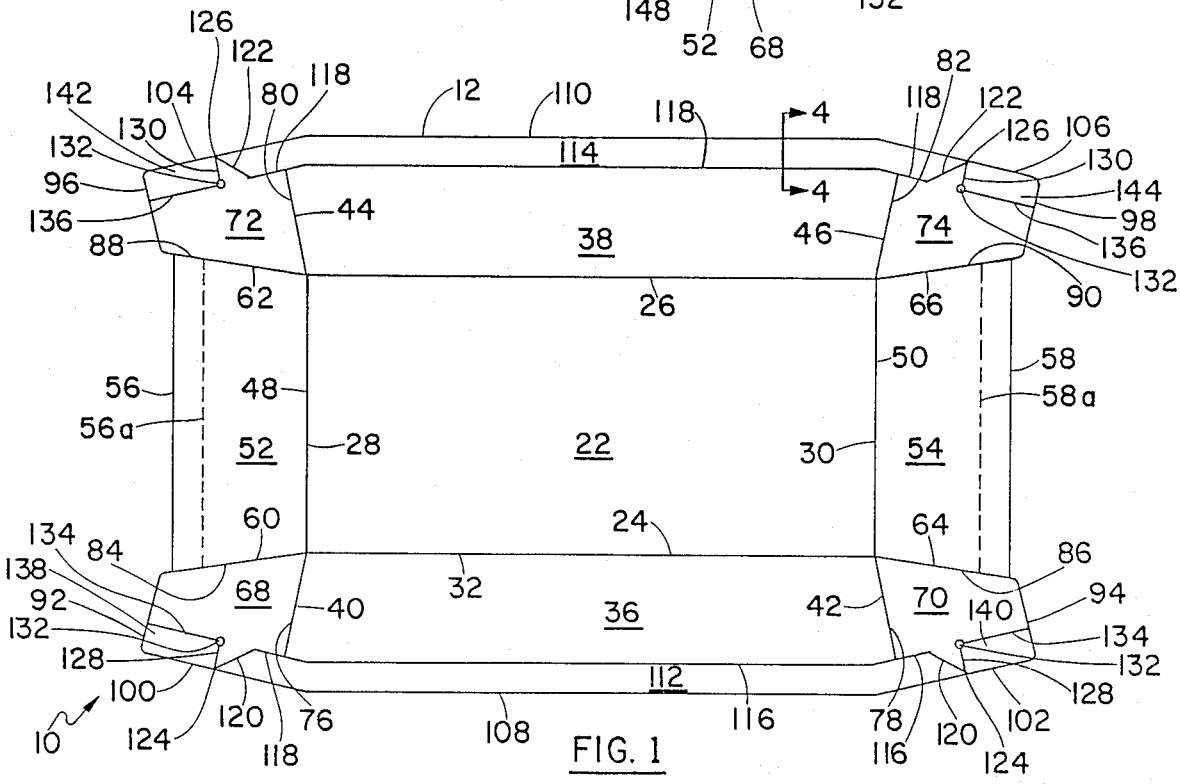
FIG. 1 is a top plan view of the cut and scored blank from which the tote carrier of this invention is constructed.

The tote carrier 10 is preferably constructed from a single sheet of corrugated plastic material, cut and scored to form a blank 12 as shown in FIG. 1. As shown in FIG. 4*b*, the corrugated plastic sheet material is composed of a first planar ply 14, and a second planar ply 16 spaced apart a distance from the first planar ply 14, with a convoluted intermediate ply 18 extending therebetween and being attached to each planar ply 14, 16. A multiplicity of air pockets 20 are formed by these plys 14, 16, 18 and extend throughout the length of the sheet, thereby defining a longitudinal grain in the corrugated plastic. In forming or extrusion molding the corrugated plastic sheet material using various known methods, the convoluted intermediate ply 18 may take the form of a multiplicity of straight beam members 18 as shown in FIG. 4*a*, those beam members 18 extending generally perpendicularly between the planar plys 14, 16 and attached thereto at each end of the beam members 18.

Referring to FIG. 1, the blank 12 comprises a rectangular bottom panel 22 defining a pair of opposing side edges 24, 26 and a pair of opposing end edges 28, 30 and hingedly connected thereto along scored fold lines 32, 34 are a pair of side wall panels 36, 38. Each side wall panel 36, 38 defines a pair of opposing end edges 40, 42 and 44, 46, respectively, with these end edges 40, 42, 44, 46 being angled slightly longitudinally outward relative to the lines defined by the end edges 28, 30 of the bottom panel 22.

Extending from each end edge 28, 30 of the bottom panel 22 along scored fold lines 48, 50 is an end wall panel 52, 54. Each end wall panel 52, 54 defines an outer edge 56, 58 parallel to and opposing side edges 60, 62, 64, 66. The side edges 60, 62, 64, 66 are angled slightly laterally outward relative to the lines defined by the side edges 24, 26 of the bottom panel 22.

Extending from the end edge 40, 42, 44, 46 of each side wall panel 36, 38 is an end foldover panel 68, 70, 72, 74, which is hingedly connected to the side wall panel 36, 38 along a scored fold line 76, 78, 80, 82. Each inner side edge 84, 86, 88, 90 of the end foldover panels 68, 70, 72, 74 extends parallel to and is completely separated from the side edges 60, 62, 64, 66 of the end wall panels 52, 54 by cut lines which are cut entirely through the surface of the blank 12. Each end foldover panel 68, 70, 72, 74 extends longitudinally outward from the side wall panels 36, 38 a distance not greater than one half the length of the end edge 28, 30 of the bottom panel 22, and terminates in an end edge 92, 94, 96, 98 which is generally parallel to the end edge 40, 42, 44, 46 of the adjoining side panel 36, 38. The outer side edges 100, 102, 104, 106 of the end foldover panels 68, 70, 72, 74 are angled slightly laterally inward relative to the lines defined by the outer side edges 108, 110 of each side wall panel 36, 38.

Extending longitudinally along each side wall panel 36, 38 and into each end foldover panel 68, 70, 72, 74 is a narrow handle strap 112, 114. The handle straps 112, 114 are defined by and separated from the side wall panels 36, 38 and end foldover panels 68, 70, 72, 74 by cut lines 116, 118 which extend entirely through the surface of the blank 12. The cut lines 116, 118 may be continuously formed throughout the side wall panels 36, 38 and end foldover panels 68, 70, 72, 74, or may be perforated or substantially continuous with the exception of some point in continuities where the handle straps 112, 114 remain connected to the side wall panels 36, 38 or end foldover panels 68, 70, 72, 74 to retain the handle straps 112, 114 in position along the sides of the receptacle 134 until the handle straps 112, 114 are to be used. These point incontinuities in the cut lines 116, 118 should be narrow enough that the corrugated plastic sheet material can be easily broken to release the handle straps.

Each cut line 116, 118 is parallel to the outer side edge 108, 110 of the side wall panel 36, 38 and the outer side edges 100, 102, 104, 106 of the end foldover panels 68, 70, 72, 74 along the length that the cut line 116, 118 traverses the corresponding side panels 36, 38 or end foldover panels 68, 70, 72, 74. The handle straps 112, 114 are therefore a uniform width measured perpendicular to the outer side edges 108, 110 of the side wall panels 38, 38 and the outer side edges 100, 102, 104, 106 of the end foldover panels 68, 70, 72, 74.

Each strap handle 112, 114 terminates in a scored, angled fold line 120, 122 which extends from the midpoint 124, 126 of each outer edge 100, 102, 104, 106 of the end foldover panel 68, 70, 72, 74 inwardly at a 45 degree angle to meet the end of the cut line 116, 118. Perpendicular fold lines 128, 130 extend inwardly a distance equal to the width of the handle straps 112, 114 from the midpoint 124, 126 of the outer side edge 100, 102, 104, 106 of the end foldover panel 68, 70, 72, 74 perpendicular to those outer side edges 100, 102, 104, 106, respectively, thereby intersecting with the angled fold lines 120, 122, with each perpendicular fold line 128, 130 terminating in a small diameter aperture 132.

Scored fold lines 134, 136 in the end foldover panels 68, 70, 72, 74 adjacent to the perpendicular fold lines 128, 130 and apertures 132, which extend parallel to both the cut lines 116, 118 and the outer edges 100, 102, 104, 106 thereof and intersect the apertures 132 and the end edges 92, 94, 96, 98, define control tab portions 138, 140, 142, 144 of the end foldover panels 68, 70, 72, 74.

Figure 3:
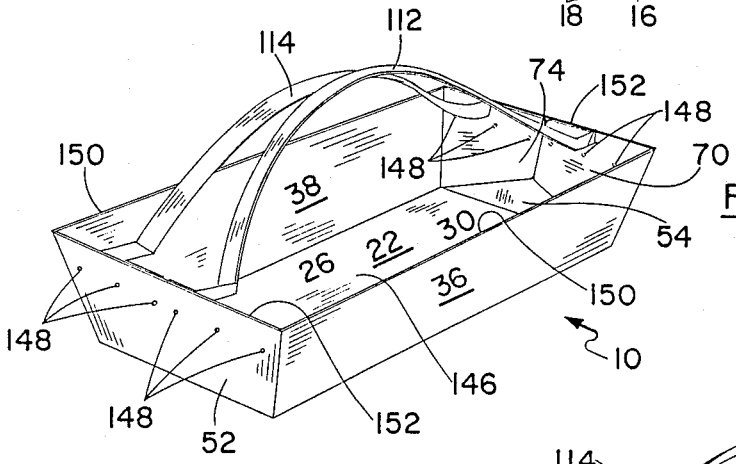
FIG. 3 is a perspective view of an embodiment of the tote carrier of FIG. 1 wherein the end foldover panels are disposed on the interior side of the end wall panels.
Figure 2:
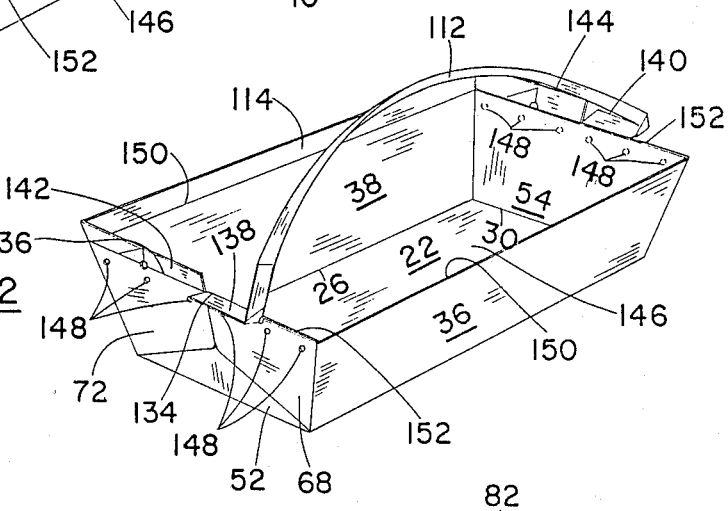
FIG. 2 is a perspective view of an embodiment of the tote carrier of FIG. 1 wherein the end foldover panels are disposed on the exterior side of the end wall panels.

In operation, the blank 12 is folded to an upright position whereby the tote carrier 10 defines a three dimensional receptacle region 146 as shown in FIGS. 2 and 3.

In the embodiment shown in FIG. 3, the side walls 36, 38 of the tote carrier 10 are folded upwardly across the scored fold lines 32, 34, and the end foldover panels 68, 70, 72, 74 are then folded inwardly across the scored fold lines 76, 78, 80, 82, to an upright position where at the outer side edges 100, 102, 104, 106 of the end foldover panels 68, 70, 72, 74 are parallel to the end edges 28, 30 of the bottom panel 22, and the end edges 92, 94 of the end foldover panels 68, 70 adjoining one side wall panel 36 are in close confronting relation with the outer end edges 96, 96 of the end foldover panels 72, 74 adjoining the opposing side wall panel 38. The end wall panels 52, 54 are then folded upwardly across the scored fold lines 48, 50 into contact with the end foldover panels 68, 70, 72, 74, and are fastened thereto using thermal or sonic welds 148 or other suitable fastening means. The outer side edges 108, 110 of the side wall panels 36, 38 and the outer end edges 56, 58 of the end wall panels 52, 54 define the top side edges 150 and top end edges 152, respectively, of the tote carrier 10 and receptacle region 146 when the tote carrier 10 is folded to its upright position.

In the embodiment shown in FIG. 2, the end wall panels 52, 54 are folded upwardly prior to folding the end foldover panels 68, 70, 72, 74 inwardly, thereby disposing the end wall panels 52, 54 on the interior of the end foldover panels 68, 70, 72, 74 rather than on the exterior, as in the embodiment shown in FIG. 3. In this embodiment, the end wall panels 52, 54 extend outwardly from the end edges 28, 30 of the bottom panel 22 to outer end edges **56*a*, 58*a* (as shown in FIG. 1) a distance equal to the maximum height of the end foldover panels 68, 70, 72, 74 measured between the inner side edges 84, 86, 88, 90 and the outer side edges 100, 102, 104, 106** thereof.

In this embodiment, the control tab portions 138, 140, 142, 144 of the end foldover panels 68, 70, 72, 74 adjacent to and defined by the perpendicular fold lines 128, 130 and fold lines 134, 136 are folded outwardly across those scored fold lines 134, 136, which automatically pivots the handle straps 112, 114 upwardly and inwardly to a raised carrying position disposed above the receptacle region 146 as shown in FIG. 2.

It should be noted that if the end wall panels 52, 54 extend outwardly from the bottom panel 22 only as far as the outer end edge **56*a*, 58*a*, then the end foldover panels 68, 70, 72, 74 may be folded on either the interior or exterior sides of the end wall panels 52, 54 and still permit the automatic pivoting motion of the handle straps 112, 114 when the control tab portions 138, 140, 142, 144 of the end foldover panels 68, 70, 72, 74 are folded outwardly across the fold lines 134, 136 as described above, although positioning the end foldover panels 68, 70, 72, 74 on the exterior of the end wall panels 52, 54 prevents any obstruction of the control tab portions 138, 140, 142, 144 by the edges 56***a*, 58*a* of the end walls 52, 54.

This embodiment also permits greater head room between the ends of the handle straps 112, 114 and the articles received within the receptacle region 146 proximate to the end wall panels 52, 54.

As the handle straps 112, 114 are pivoted upwardly, and the control tab portions 138, 140, 142, 144 of the end foldover panels 68, 70, 72, 74 are folded outwardly and downwardly across fold lines 134, 136, the handles will naturally fold upwardly across the angled fold lines 20, 122 and perpendicular fold lines 128, 130, thus orienting a wide, planar surface of the handle straps 112, 114 in the horizontal direction to provide a maximum surface area for gripping and support. The handle straps 112, 114 may also be rotated in opposite directions one quarter turn relative to one another, so that the thinner edge surfaces are oriented downward when a narrower support surface is preferred in the gripping hand.

The edges of the handle straps 112, 114 need not be straight, but rather may be scalloped to provide a finger gripping region, may be curved convexly or concavely to narrow or widen the gripping or supporting surface of the handle straps 112, 114, or may be made in any irregular shape or provided with a decorative pattern to distinguish the tote carrier 10. The edges of the side wall panels 36, 38 will then take on a particular shape or curvature depending upon the path of the cut lines 116, 118. If the handle straps 112, 114 are made to curve convexly, then the side walls 36,38 will each define a corresponding convex recess.

It is further understood that the tote container 10 may include only one side wall 36 or 38, and one handle strap 112 or 114, with the corresponding end foldover panels 68, 70 or 72, 74 being lengthened to position the ends of the handle strap 112 or 114 along the centerline or center of mass of the receptacle region 146. In this embodiment, the opposing side edges 60, 64 or 62, 66 of the end wall panels 52, 54 may be cut parallel to the side edges 24, 26 of the bottom panel 22, or tapered in the opposite direction to form a scoop-shaped side opening. This presents an open sided tote container (not shown) which may be particularly suited for certain applications such as gathering produce or the like.

While the preferred embodiments of the present invention have been described, it should be recognized that various changes, adaptations, and modifications may be made therein without departing from the spirit of the invention and scope of the appended claims.

What is claimed is:

1. A blank, said blank cut and scored from a generally planer sheet of material and foldable to form a generally upright carrier defining a receptacle region, said blank comprising:

a bottom panel defining a pair of opposing side edges and a pair of opposing end edges;

at least one side wall panel extending from and hingedly connected to one of said side edges of said bottom panel along a scored fold line, said side wall panel further defining a pair of opposing end edges and an outer side edge;

a pair of end wall panels, each said end wall panel extending from and hindgedly connected to one of said end edges of said bottom panel along scored fold lines;

at least a pair of end foldover panels, each said end foldover panel extending from and hingedly connected to one of said end edges of said side wall panel along scored fold lines; and one or more handle straps, each said handle strap having a pair of opposing ends, each of said ends of said handle strap extending from and being hingedly connected to one of said end foldover panels, with said handle strap being defined by and separated from said end foldover panels and said side wall panel by at least one substantially continuous cut line extending entirely through said end foldover panels and said side wall panel.

2. The blank of claim 1 wherein each of the end foldover panels further defines a control tab portion, said control tab portion extending from and hingedly connected to one of the end foldover panels and extending from and hingedly connected to one end of the handle strap along scored fold lines.

3. The blank of claim 2 wherein each said handle strap has an inner side edge and an outer side edge, each said handle strap further comprising:

at least two angled fold lines extending substantially across the handle strap at a generally acute angle relative to the substantially continuous cut line, each angled fold line being located at a position along the handle strap adjoining an opposing one of the end foldover panels, and intersecting the outer side edge of the handle strap at a point; and at least two perpendicular fold lines extending substantially across the handle strap at a generally perpendicular angle to the substantially continuous cut line, each perpendicular fold line being located at a position along the handle strap adjoining an opposing one of the end foldover panels, said perpendicular fold lines intersecting the outer edge of the handle strap at the points at which the angled fold lines intersect the outer edge of the handle strap.

4. The blank of claim 3 wherein the angle of the angled fold line is approximately 45 degrees.

5. The tote carrier of claim 3 wherein each of the perpendicular fold lines terminates in an aperture positioned opposing the outer edge of the handle strap, said apertures defined by and extending completely through the surface of the end foldover panels, with the fold line along which each control tab portion of each of the foldover panels are connected to the end foldover panel also intersecting said aperture.

6. The blank of claim 1 wherein the number of the side wall panels is two, each of the side wall panels extending from and being hingedly connected to an opposing one of the side edges of the bottom panel, the number of the end foldover panels is four, and the number of the handle straps is two, the opposing ends of each of the handle straps extending from and connected to an opposing one of the end foldover panels which extend from and are connected to one of the side wall panels.

7. The blank of claim 1 wherein the sheet material is a corrugated plastic.

8. A tote carrier, said tote carrier defining a generally open top receptacle region for carring an article, said tote carrier comprising:

a generally rectangular bottom panel defining a pair of opposing side edges and a pair of opposing end edges;

at least one side wall panel extending from and hingedly connected to one of said side edges of said bottom panel along a fold line, said side wall panel being folded upwardly across said fold line by which said side wall panel is connected to said bottom panel, said side wall panel further defining a pair of opposing end edges and a top side edge;

a pair of end wall panels, each said end wall panel extending from and hingedly connected to one of said end edges of said bottom panel along fold lines, said end wall panels being folded upwardly across said fold lines by which said end wall panel is connected to said bottom panel, said end wall panels each further defining a pair of opposing side edges and a top edge thereof;

at least a pair of end foldover panels, each said end foldover panel extending from and hingedly connected to one of said end edges of said side wall panel along fold lines, said end foldover panels being folded inwardly across said fold lines by which said end foldover panel is connected to said side wall panel and into parallel abutting contact with said end wall panels, said end foldover panels being fastened to said end wall panels; and one or more handle straps, each said handle strap having a pair of opposing ends, each of said ends of said handle strap extending from and being hingedly connected to one of said end foldover panels, with said handle strap being defined by and separated from said end foldover panels and said side wall panel by at least one substantially continuous cut line extending entirely through said end foldover panels and said side wall panel, whereby the article may be received within the receptacle region.

9. The tote carrier of claim 8 further comprising:

at least a pair of control tab portions, each said control tab portion defined by one of the end foldover panels and hingedly connected thereto along fold lines, said control tab portion extending from and hingedly connected to one of the end foldover panels and extending from and hingedly connected to one of the ends of the handle strap.

10. The tote carrier of claim 9 wherein each said handle strap has an inner side edge and an outer side edge, each said handle strap further comprising:

at lease two angled fold lines extending substantially across the handle strap at a generally acute angle relative to the substantially continuous cut line, each angled fold line being located at a position along the handle strap adjoining an opposing one of the end foldover panels, and intersecting the outer side edge of the handle strap at a point; and whereby the handle strap may be folded to a generally raised carrying position above the open top of the receptacle region by folding the control tab portions outwardly across the fold lines by which the control tab portion are connected to the end foldover panels.

11. The tote carrier of claim 10 wherein the angle of the angled fold line is approximately 45 degrees.

12. The tote carrier of claim 10 wherein each of the perpendicular fold lines terminates in an aperture positioned opposing the outer edge of the handle strap, said apertures defined by and extending completely through the surface of the end foldover panels, with the fold line along which each control tab portion of each of the foldover panels are connected to the end foldover panel also intersecting said aperture.

13. The tote carrier of claim 10 wherein the control tab portions of the end foldover panels are positioned such that the fold lines by which the control tab portions are connected to the end foldover panels are substantially parallel to the top edges of the end wall panels to which the end foldover panels are fastened.

14. The tote carrier of claim 10 wherein the minimum distance between the intersection of one of the side edges of the bottom panel and one of the end edges of the bottom panel and the nearest cut line is substantially equal to the distance between the fold line along which the bottom panel is connected to the end wall panel and the top edge of the end wall panel.

15. The tote carrier of claim 8 wherein the number of the side wall panels is two, each of the side wall panels extending from and being hingedly connected to an opposing one of the side edges of the bottom panel, the number of the end foldover panels is four, and the number of the handle straps is two, the opposing ends of each of the handle straps extending from and connected to an opposing one of the end foldover panels which extend from and are connected to one side of the side wall panels.

16. The tote carrier of claim 8 which is folded from a unitary blank, said blank being cut and scored from a corrugated plastic sheet material.

* * * * *